United States Patent [19]

Kaiser

[11] Patent Number: 4,653,119

[45] Date of Patent: Mar. 31, 1987

[54] CLOTHING PROTECTOR

[76] Inventor: Walter L. Kaiser, 7520 Peach St., Erie, Pa. 16509

[21] Appl. No.: 867,040

[22] Filed: May 27, 1986

[51] Int. Cl.[4] ..... A41D 27/16

[52] U.S. Cl. ..... 2/60

[58] Field of Search ..... 2/60, 131, 129, 127, 2/232

[56] References Cited

U.S. PATENT DOCUMENTS

| | | | |
|---|---|---|---|
| 2,634,420 | 4/1953 | Jackson . | |
| 3,022,514 | 2/1962 | Kaiser | 2/60 |
| 3,200,413 | 8/1965 | Vaughan | 2/60 |

*Primary Examiner*—Doris L. Troutman

*Attorney, Agent, or Firm*—Charles L. Lovercheck; Wayne L. Lovercheck; Dale R. Lovercheck

[57] ABSTRACT

A disposable protector for a garment collar made up of a thin plastic sheet of water impervious material glued to a first side of a non-woven material and a pressure sensitive adhesive surface on the second side of the sheet. A removable paper strip is attached to the pressure sensitive material which can be removed and the protector attached to a garment collar band by means of the pressure sensitive adhesive with the non-woven material adjacent the neck of the wearer.

1 Claim, 3 Drawing Figures

CLOTHING PROTECTOR

REFERENCE TO PRIOR ART

This application is an improvement over U.S. Pat. No. 3,022,514. The said patent shows a disposable collar protector made up of a plastic sheet with protection material cemented to one side and pressure sensitive adhesive on the other side, approximately ⅞" wide with pressure sensitive adhesive on both sides. One side of the adhesive is covered with a paper liner, split at the center for convenience of removal for applying to the shirt collar or cuffs. The exposed adhesive on the opposite side of this tape is for affixing the batiste, muslin, broad cloth, nylon or percale fabric, to receive the soil and perspiration from the tissue, rather than permitting the soil to permate the fabric of the shirt collar or cuffs. Applicant has found that the adhesive fastening the batiste, percale or broad cloth, all having a 90 to 120 mesh per square inch, tend to bleed through this material, causing the fine hair on the tissue to adhere to the adhesive which surfaced through these woven materials, causing much discomfort from the pulling of the hair of the wearer, when the wearer looks to the left or right. Applicant has solved the bleeding problem by adding a thin polyethlene vapor barrier, having on one side a soft comfortable cellulose fiber material to receive the soil from the tisue. A removable paper liner covers the exposed adhesive on the opposite side of the strip, having graduations from ½", 1", 1½", 2", 2½", etc., and at every five inches mark a number 5 will appear for convenience of cutting at the desired length. After the strip has been cut from the roll, the paper liner is conveniently removed exposing the adhesive for affixing to the collar or cuffs of the shirt by direct pressure.

BACKGROUND OF THE INVENTION

This invention relates to clothing protectors and, more particularly, to an improved removable protective cover for shirt collars.

So-called white collar workers who ordinarily wear white shirts and who work as office personnel, salesmen, etc. are constantly confronted with the difficulty of keeping the inside bands of their shirt collars clean. Dust entrained in the air combined with perspiration from the worker's neck, especially in warm weather, forms a coating of discoloration on the inside of the shirt collar which is unsightly and disconcerting to the wearer of the shirt. Ordinarilly, the outside parts of the shirt are not soiled as quickly as the neck band, and therefore, the objectionable area is the local area adjacent the neck of the wearer of the shirt.

GENERAL STATEMENT OF THE INVENTION

Applicant has discovered that a collar protector which is neat in appearance and convenient to use can be made by providing a moisture impervious sheet about the width of a collar band with a soft removable strip of material the same color as the shirt that is approximately ⅞" wide with pressure sensitive adhesive on both sides. One side of the adhesive is covered with a paper liner, split at the center for convenience of removal for applying to the shirt collar or cuffs. The exposed adhesive on the opposite side of this tape is for affixing the batiste, muslin, broad cloth, nylon or percale fabric, to receive the soil and perspiration from the tissue, rather than permitting the soil to permate the fabric of the shirt collar or cuffs. Applicant has found that the adhesive fastening the batiste, percale or broad cloth, all having a 90 to 120 mesh per square inch, tend to bleed through this material, causing the fine hair on the tissue to adhere to the adhesive which surfaced through these woven materials, causing much discomfort from the pulling of the hair of the wearer, when the wearer looks to the left or right. Applicant has solved the bleeding problem by adding a thin polyethlene vapor barrier, having on one side a soft comfortable cellulose fiber material to receive the soil from the tissue. A removable paper liner covers the exposed adhesive on the opposite side of the strip, having graduations from ½", 1", 1½", 2", 2½", etc., and at every five inches mark a number 5 will appear for convenience of cutting at the desired length. After the strip has been cut from the roll, the paper liner is conveniently removed exposing the adhesive for affixing to the collar or cuffs of the shirt by direct pressure.

OBJECTS OF THE INVENTION

It is accordingly an object of the invention to provide a simple device of the type described adapted to adhesively engage the inside of a shirt collar and completely cover the inside band of the shirt collar to protect it from the wearer's neck.

Another object of the invention is to provide a protective cover for the inside of a shirt collar which is simple in construction, economical to manufacture, and simple and efficient to apply and to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DETAILED DESCRIPTION OF THE DRAWINGS

Figure 1:
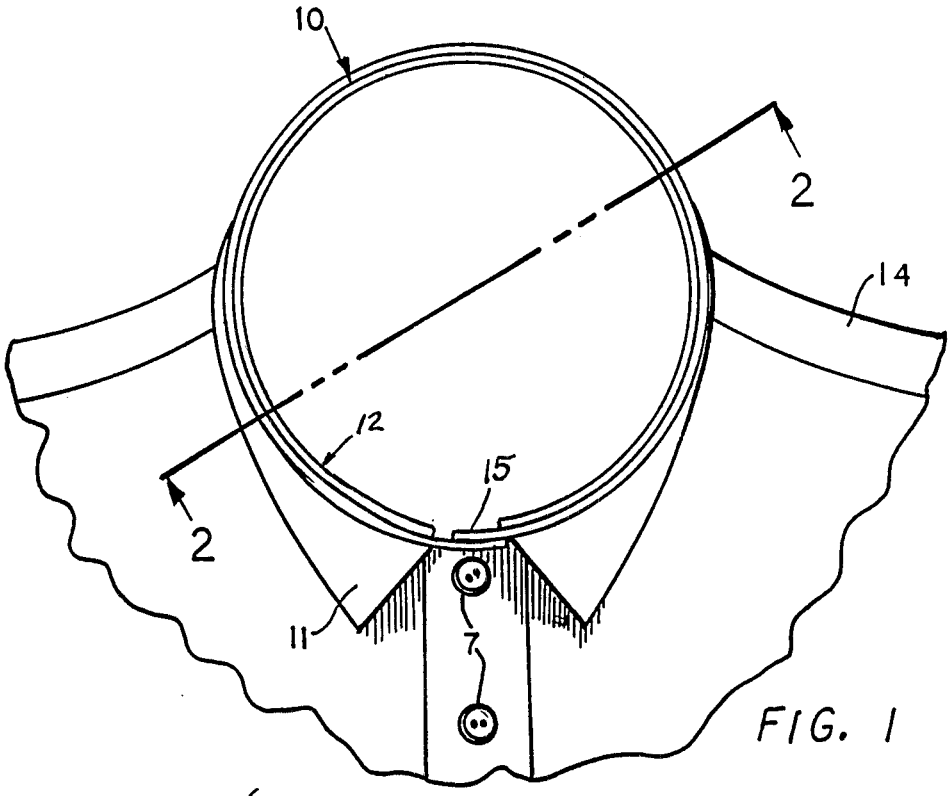
FIG. 1 is a view of a shirt having an improved collar protective device according to the invention.
Figure 2:
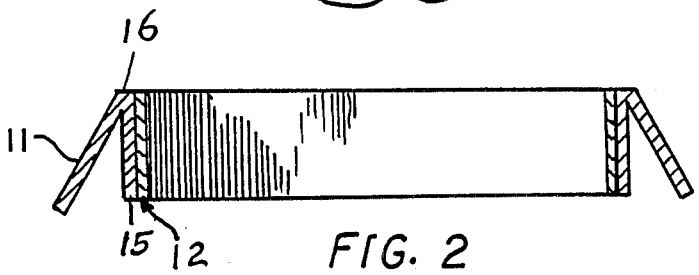
FIG. 2 is a cross sectional view of the shirt taken on line 2—2 of FIG. 1.
Figure 3:
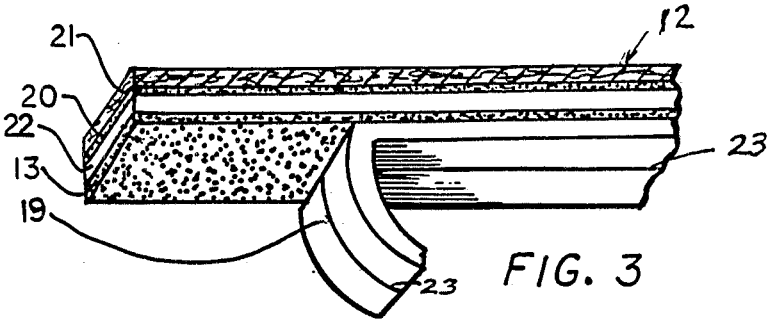
FIG. 3 is an enlarged partial view of the protective device showing the material thereon and the cover strip partly removed.

Now with more particular reference to the drawings, a shirt 14 is shown having a collar 10. The shirt 14 has a neck band 15 which forms the terminus of the upper portion of the shirt material. The neck band 15 is stitched to the inside of the shirt in a conventional manner. The neck band 15 terminates at its upper end in a fold 16 and the collar then extends outwardly to form an outside flap 11. Buttons 7 are provided to close the shirt in the usual manner.

A protector 12 preferably has a thin water impervious plastic strip of material 22, such as Mylar having a pressure sensitive adhesive coating 13 on an outside first surface be attached to paper backing sheet 19. Backing paper 19 can be split at 23 to make it easier to remove. The paper backing sheet 19 may be pulled from the pressure sensitive adhesive coating 13 and the device pressed against the inside surface of the neck band 15.

The second adhesive coating 20 of the protector 12 opposite the first pressure sensitive adhesive coating 13 will have adhered thereto a sheet of non-woven fiber material 21, such as white non-woven cotton or other suitable material, which may be attached to the neck band by the adhesive 13 on the second side of the protector.

The material 21 may be, for example, a non-woven fiber, paper towel material, or it could be a material such as used in disposable hospital under pads having a polyurethane vapor barrier. The adhesive 20 could be a permanent type of glue, such as used to attach the paper material to the water impervious sheet in disposable hospital under pads.

The paper backing 19 is supported on the protector 12 when stored to protect the adhesive 13 thereon. The strip can be cut off to the proper length and the protector 12 bent laterally to cause the edges of the backing 19 to break away at the edges, thereby facilitating removal.

The protector 12 may be stored in rolls with the paper backing calibrated. With the backing in place when a user desires to protect a sixteen inch collar, for example, he will cut off a length of sixteen inches from the roll. It may be split in its center so that half can be torn off at a time to make it easier to handle.

By applying the improved protector 12 to a shirt by removing the paper backing 19 and pressing the adhesive side of the protector against the shirt neck band 15, the shirt can be worn one day and then the protector 12 removed and replaced by another protector. The shirt can then be worn the following day with substantially the appearance of a clean shirt. Therefore, the cost of laundering the shirt will be reduced and wear and tear on the shirt itself due to drastic treatment during laundry will be decreased.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A disposable protector for a garment collar adapted to be attached to the inside of the neck band of said garment adjacent the neck of the wearer comprising a band of thin moisture impervious sheet material approximately the width of the neck band of a collar having pressure sensitive adhesive on one said side thereof, a removable sheet of backing material fixed to the side of the sheet opposite said adhesive and adapted to be removed when said protector is attached to said garment collar, and a non-woven fibrous material resembling the material of said garment collar in appearance fixed to said moisture impervious sheet on the side thereof opposite said pressure sensitive adhesive, said removable sheet being adapted to be removed from said pressure sensitive adhesive and said protector being adapted to be affixed to the collar band of a garment with said impervious fibrous material adjacent the neck of a wearer whereby the garment has a fresh clean appearance.

* * * * *